US009630292B2

(12) United States Patent
Kawasaki

(10) Patent No.: US 9,630,292 B2
(45) Date of Patent: Apr. 25, 2017

(54) SINGLE SIDE POLISHING APPARATUS FOR WAFER

(71) Applicant: SUMCO Corporation, Tokyo (JP)

(72) Inventor: Tomonori Kawasaki, Tokyo (JP)

(73) Assignee: SUMCO Corporation, Minato-ku (JP)

( * ) Notice: Subject to any disclaimer, the term of this patent is extended or adjusted under 35 U.S.C. 154(b) by 0 days.

(21) Appl. No.: 15/048,794

(22) Filed: Feb. 19, 2016

(65) Prior Publication Data

US 2016/0167191 A1 Jun. 16, 2016

Related U.S. Application Data

(62) Division of application No. 13/935,376, filed on Jul. 3, 2013, now Pat. No. 9,266,213.

(30) Foreign Application Priority Data

Jul. 5, 2012 (JP) ..... 2012-151187

(51) Int. Cl.
*B24B 37/005* (2012.01)
*B24B 37/10* (2012.01)
*B24B 7/22* (2006.01)

(52) U.S. Cl.
CPC ..... *B24B 37/005* (2013.01); *B24B 7/228* (2013.01); *B24B 37/107* (2013.01)

(58) Field of Classification Search
CPC ... B24B 37/005–37/015; B24B 37/107; B24B 37/26; B24B 7/228
See application file for complete search history.

(56) References Cited

U.S. PATENT DOCUMENTS 5,102,099 A * 4/1992 Brown ..... B24B 29/04 451/283
5,516,324 A * 5/1996 Matsuyama ..... B24B 19/06 451/127
2002/0086613 A1 7/2002 Hatano
2004/0053007 A1* 3/2004 Huh ..... B24B 37/205 428/158
2004/0072505 A1 4/2004 Matsui et al.
2005/0118939 A1 6/2005 Duescher
2007/0287362 A1 12/2007 Takenouchi
2009/0061737 A1 3/2009 Sudo et al.
(Continued)

FOREIGN PATENT DOCUMENTS

JP 2000-77369 A 3/2000

*Primary Examiner* — Larry E Waggle, Jr.
*Assistant Examiner* — Henry Hong
(74) *Attorney, Agent, or Firm* — Christensen O'Connor Johnson Kindness PLLC

(57) ABSTRACT

Apparatus polishing one side of a wafer to accurately realize the desired wafer edge shape without dependence on the period of use of a polishing cloth is provided. In the apparatus of the present invention, a wafer fixed to a head is brought into contact with a polishing cloth provided on a surface of a surface plate, and the head and the surface plate are rotated, thereby polishing one side of the wafer. The contact angle of the polishing cloth (S1) is measured; the rotation speed of the head and the surface plate is determined based on the measured contact angle of the polishing cloth (S4). One side of the wafer is polished by rotating the head and the surface plate at the determined rotation speed (S5, S6).

8 Claims, 6 Drawing Sheets

(56) References Cited

U.S. PATENT DOCUMENTS

| | | | | |
|---|---|---|---|---|
| 2009/0298392 | A1* | 12/2009 | Okamoto | B24B 37/24 451/41 |
| 2010/0120343 | A1* | 5/2010 | Kato | B24B 37/24 451/533 |
| 2011/0017614 | A1 | 1/2011 | Holroyd et al. | |
| 2011/0130077 | A1 | 6/2011 | Litke et al. | |
| 2012/0277897 | A1* | 11/2012 | Zhang | B24B 37/005 700/103 |

* cited by examiner

SINGLE SIDE POLISHING APPARATUS FOR WAFER

CROSS-REFERENCE TO RELATED APPLICATION

This application is a division of U.S. application Ser. No. 13/935,376, filed Jul. 3, 2013, the disclosure of which is hereby expressly incorporated by reference herein in its entirety.

TECHNICAL FIELD

The present invention relates to a method of polishing one side of a wafer and a single side polishing apparatus for wafer.

BACKGROUND ART

CMP (chemical mechanical polishing) is employed for polishing surfaces of wafers required to be highly flat, such as semiconductor wafers. CMP is a technique in which a polishing agent having an etching effect on the work is used to etch the work while mechanically polishing the work with abrasive grains contained in the polishing agent.

Conventionally, single side polishing apparatuses such as a single side polishing apparatus 500 shown in FIG. 8 have been used for CMP. The single side polishing apparatus 500 of FIG. 8 is only an example of wafer single side polishing apparatuses, and includes a head 502 for retaining a wafer and a surface plate 510 having a polishing cloth 512. In the single side polishing apparatus 500, the head 502 retains a wafer and meanwhile presses a polishing target surface of the wafer against the polishing cloth 512 provided on the top surface of the rotating surface plate 510. The head 502 and the surface plate 510 are relatively moved by rotating the head 502 and the surface plate 510 together, thereby polishing the polishing target surface of the wafer while supplying a polishing agent 528 from a polishing agent supply means 526.

As an example of such a single side polishing apparatus, JP 2000-077369 A (PTL 1) discloses a single side polishing apparatus which measures the thicknesses of a center portion and a peripheral portion of a wafer, and controls the rotation speed of a head and a surface plate based on the measurement result, thereby leveling the amount of polishing on the wafer surface.

CITATION LIST

Patent Literature

PTL 1: JP 2000-077369 A

SUMMARY OF INVENTION

Technical Problem

PTL 1 is only a technique for reducing variation of polishing amount between a center portion and a peripheral portion of a single wafer, and is not meant to constantly realize desired amount of polishing in polishing of a plurality of wafers. In this respect, according to the studies made by the inventor of the present invention, when a plurality of wafers are polished using one polishing cloth in a conventional single side polishing apparatus under the same polishing conditions, such as rotation speed of a head and a surface plate, polishing time, and pressure applied by the wafer to the polishing cloth, it was found that the desired wafer edge shape cannot be obtained through the plurality of wafers since the polishing amount of peripheral portions of the wafers gradually increases. This is considered to be attributed to change in polishing performance of the polishing cloth from the initial stage of the use thereof to the final stage of the use thereof.

In view of the above problems, it is an object of the present invention to provide a method of polishing one side of a wafer and a single side polishing apparatus, which make it possible to accurately realize the desired wafer edge shape without dependence on the period of use of a polishing cloth.

Solution to Problem

The inventor of the present invention made further studies to achieve the above object, and thus found the following.

(1) The change in polishing performance depending on the period of use of a polishing cloth is considered to be attributed to change in the surface condition of the polishing cloth. Specifically, it is considered that the resilience of the polishing cloth decreases while the polishing cloth is used a plurality of times, and a polishing agent is accumulated on the polishing cloth, which make the peripheral portion of the wafer to be easily shaved. Consequently, he found that the contact angle of a polishing cloth is suitable as an indicator for monitoring such change in the surface condition.

(2) The polishing amount at a peripheral portion also depends on the rotation speed of a head and a surface plate. Therefore, the desired polishing amount at the peripheral portion can be obtained without dependence on the period of use of the polishing cloth by measuring the contact angle of the polishing cloth, and controlling the rotation speed of the head and the surface plate based on the measured contact angle.

The present invention completed based on the above findings primarily includes the following components.

A method of polishing one side of a wafer according to the present invention, in which a wafer fixed to a head is brought into contact with a polishing cloth provided on a surface of a surface plate, and the head and the surface plate are rotated thereby polishing one side of the wafer, comprising the steps of: measuring a contact angle of the polishing cloth; determining a rotation speed of the head and the surface plate, based on a predetermined relationship between the contact angle of a polishing cloth of the same kind as the polishing cloth and the rotation speed of the head and the surface plate for obtaining a certain wafer edge shape and on the measured contact angle of the polishing cloth; and polishing the one side of the wafer by rotating the head and the surface plate at the determined rotation speed.

In the invention, preferably, with respect to each of a plurality of certain wafer edge shapes, the relationship between the contact angle of a polishing cloth of the same kind as the polishing cloth and the rotation speed of the head and the surface plate is previously determined, and the rotation speed of the head and the surface plate is determined with the use of the relationship corresponding to the target wafer edge shape of the wafer to be polished.

In the invention, preferably, a polishing agent on the polishing cloth is removed by rotating the surface plate before measuring the contact angle.

In the invention, preferably, when the measured contact angle is equal to or less than a threshold value, polishing is performed using the polishing cloth, whereas when the measured contact angle exceeds the threshold value, the polishing is performed after the polishing cloth is replaced.

A single side polishing apparatus for wafer according to the present invention includes a head for fixing a wafer; a surface plate having a surface provided with a polishing cloth; and a rotating mechanism for rotating the head and the surface plate. The wafer fixed to the head is brought into contact with the polishing cloth, and the head and the surface plate are rotated to polish one side of the wafer. The single side polishing apparatus for wafer comprises: a measuring device for measuring a contact angle of the polishing cloth; a control unit for determining a rotation speed of the head and the surface plate, based on a predetermined relationship between the contact angle of a polishing cloth of the same kind as the polishing cloth and the rotation speed of the head and the surface plate for obtaining a certain wafer edge shape and on the contact angle of the polishing cloth, measured with the measuring device and for driving the rotating mechanism so that the head and the surface plate are rotated at the determined rotation speed.

Advantageous Effect of Invention

A single side polishing method and a single side polishing apparatus of the present invention can accurately realize the desired wafer edge shape without dependence on the period of use of the polishing cloth by keeping track of the surface condition of a polishing cloth based on the contact angle, and determining the rotation speed of a surface plate and a head.

DESCRIPTION OF EMBODIMENTS

Embodiments of the present invention will be described in detail below.

(Single Side Polishing Apparatus for Wafer)

Figure 1:
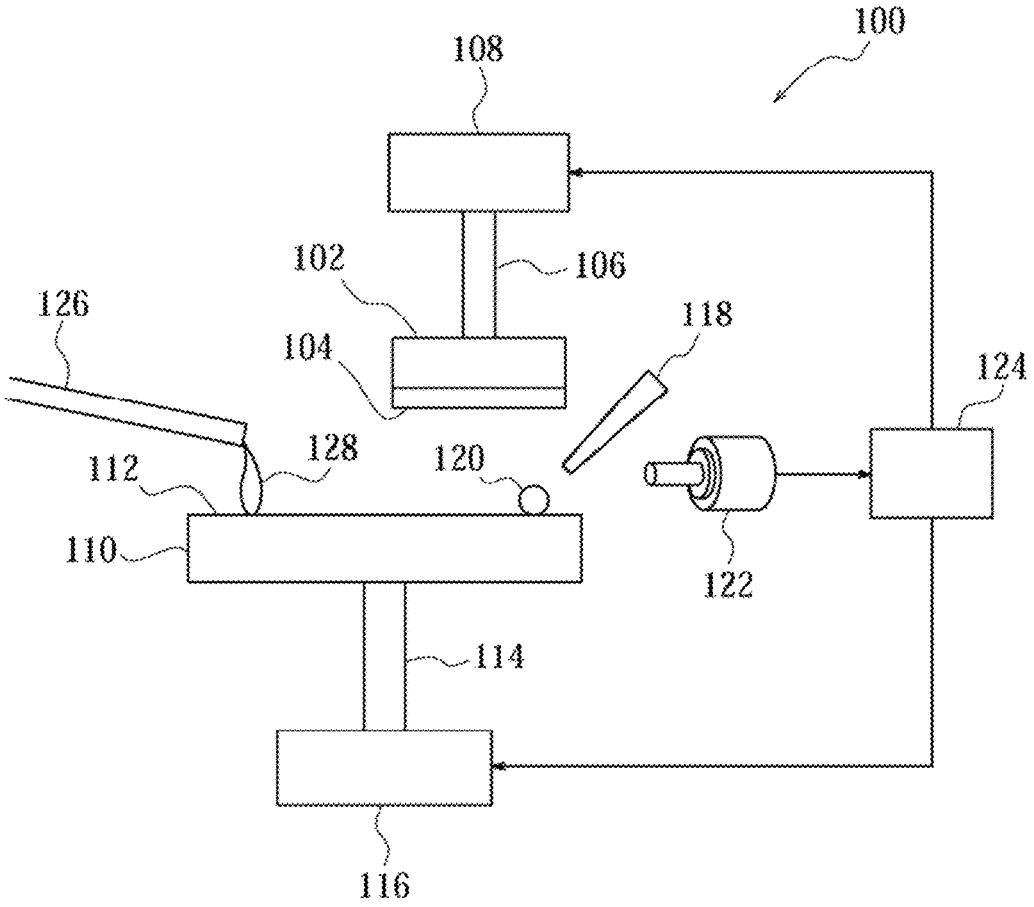
FIG. 1 is a schematic view of a single side polishing apparatus for wafer 100 according to an embodiment of the present invention.

FIG. 1 shows a single side polishing apparatus for wafer 100 according to an embodiment of the present invention. The single side polishing apparatus for wafer 100 includes a head 102 for fixing a wafer 104, a surface plate 110 having a surface provided with a polishing cloth 112, and motors 108 and 116 serving as a rotating mechanism for rotating the head 102 and the surface plate 110. One side of the wafer 104 fixed to the head 102 is polished by bringing the wafer 104 into contact with the polishing cloth 112, rotating the head 102 and the surface plate 110 together to relatively move the head 102 and the surface plate 110, while supplying a polishing agent 128 from a polishing agent supply 126.

The single side polishing apparatus for wafer 100 has a measuring device 122 for measuring the contact angle of the polishing cloth 112. The measuring device 122 measures the contact angle of a drop 120 supplied onto the polishing cloth 112 from a drop supply 118. The measurement shows the surface condition of the polishing cloth 112 used for polishing. The data of the contact angle is then output from the measuring device 122 to a control unit 124. The control unit 124 determines the rotation speed of the head 102 and the surface plate 110 based on the data of the contact angle output from the measuring device 122. The head 102 is descended by means of the head elevating shaft 106 while retaining the wafer 104, and the wafer 104 is brought in contact with the polishing cloth 112 of the surface plate 110. The control unit 124 drives the motors 108 and 116 so as to rotate the head 102 and the surface plate 110 at a determined rotation speed.

A method of determining the rotation speed of the head 102 and the surface plate 110 using the control unit 124 will be described below.

Figure 4:
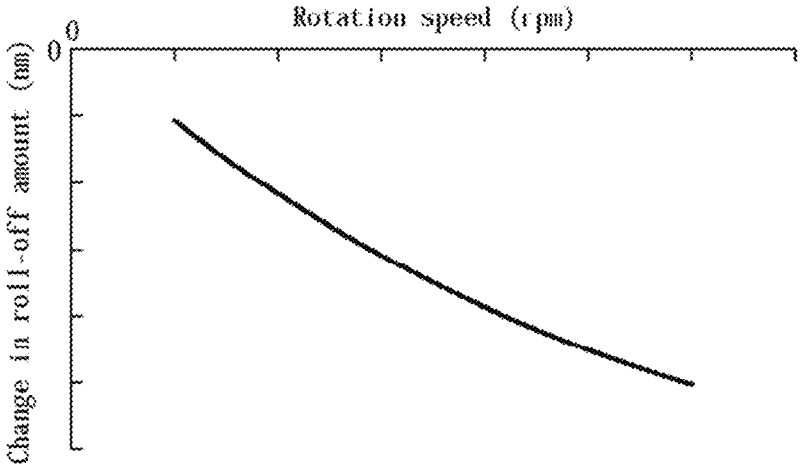
FIG. 4 is a graph showing the relationship between the rotation speed of a head and a surface plate and change in the roll-off amount.

FIG. 4 shows the relationship between the rotation speed of a head and a surface plate and change in the roll-off amount of a wafer in a case where the contact angle of the polishing cloth is a certain value (30°, to be specific), and the polishing time is constant (360 s, to be specific). Roll-off is a phenomenon in which the peripheral portion of a wafer becomes smaller than the center portion thereof in thickness due to polishing. "Change in roll-off amount" herein means the distance between the position of the edge of a wafer surface to be polished and the position of the edge of the wafer surface having been polished, in the thickness direction. As evident from FIG. 4, the higher the rotation speed of a head and a surface plate is, the larger the change in the roll-off amount is, when a comparison is made under the same polishing conditions other than the rotation speed of the head and the surface plate.

Figure 5:
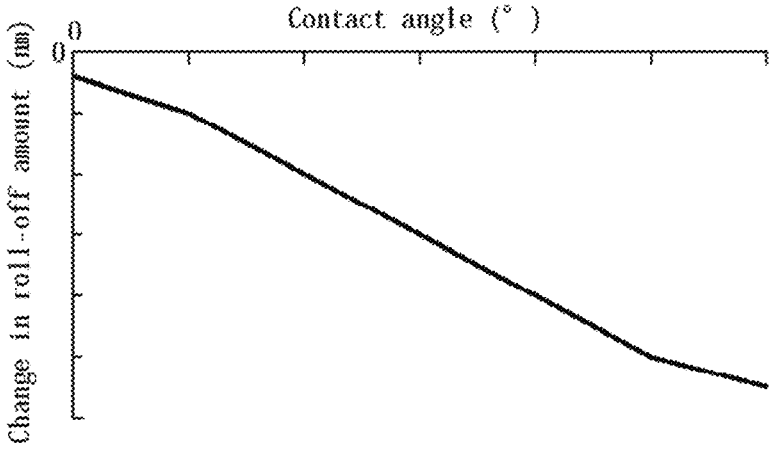
FIG. 5 is a graph showing the relationship between the contact angle of a polishing cloth and change in the roll-off amount.

Next, FIG. 5 shows the relationship between the contact angle of a polishing cloth and change in the roll-off amount of a wafer in a case where the rotation speed of a head and a surface plate is a certain value (30 rpm, to be specific) and the polishing time is constant (360 s, to be specific). Thus, when a comparison is made under the same polishing conditions other than the contact angle of the polishing cloth, the larger the contact angle of the polishing cloth is, the larger the change in the roll-off amount is. The inventor of the present invention made intensive studies and found the relationship shown in FIG. 5.

The inventor of the present invention found that when polishing a plurality of wafers using one polishing cloth, the contact angle of the polishing cloth increases from the initial stage of the use of the polishing cloth to the final stage of the use thereof. In other words, as in FIG. 5, even when the plurality of wafers are polished under the same polishing conditions, change in the roll-off amount varies depending on the period of use of the polishing cloth. Specifically, as the period of use of the polishing cloth is longer, the change in the roll-off amount is increased. Thus, the contact angle of a polishing cloth is found to be an indicator for monitoring change of the surface condition of the polishing cloth, which has a correlation with the change in the roll-off amount.

Figure 6:
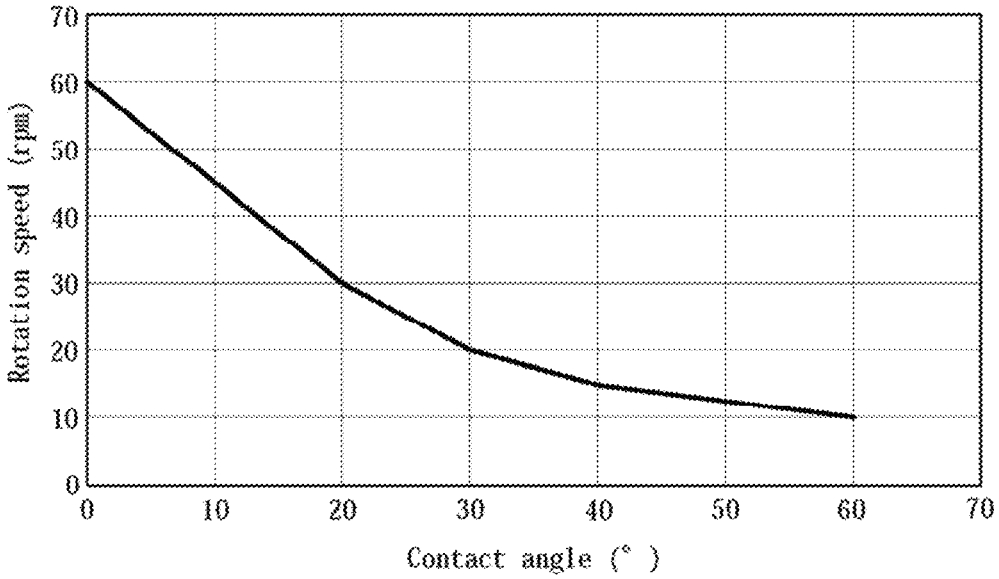
FIG. 6 is a graph used in Example 1, showing the relationship between the contact angle of a polishing cloth and the rotation speed of a head and a surface plate, where the change in the roll-off amount is 15 nm.

Further, from the relationships shown in each of FIG. 4 and FIG. 5, a standard curve showing the relationship between the contact angle of the polishing cloth and the rotation speed of a head and a surface plate can be obtained as shown in FIG. 6 in a case where the polishing time is constant (360 s, to be specific). The standard curve is for achieving the desired change in the roll-off amount. FIG. 6 shows a standard curve showing the conditions for obtaining a change of 15 nm in the roll-off amount in polishing for 360 s when using a suede polishing cloth. Using FIG. 6, the rotation speed of a head and a surface plate, which can achieve the change of 15 nm in the roll-off amount, can be determined based on the contact angle of the polishing cloth.

The single side polishing apparatus 100 of this embodiment stores the relationship shown in FIG. 6 between the contact angle of a polishing cloth of the same kind as the polishing cloth 112 and the rotation speed of the head 102 and the surface plate 110, which is previously determined for obtaining a certain change in the roll-off amount, for example, in a data table format in a memory (not shown). Upon receiving data of the contact angle of the polishing cloth 112 output from the measuring device 122, the control unit 124 reads the data table from the memory, and calculates the rotation speed of the head 102 and the surface plate 110 corresponding to the input contact angle, based on the data table. This can accurately realize the desired change in the roll-off amount without dependence on the period of use of the polishing cloth 112.

Figure 7:
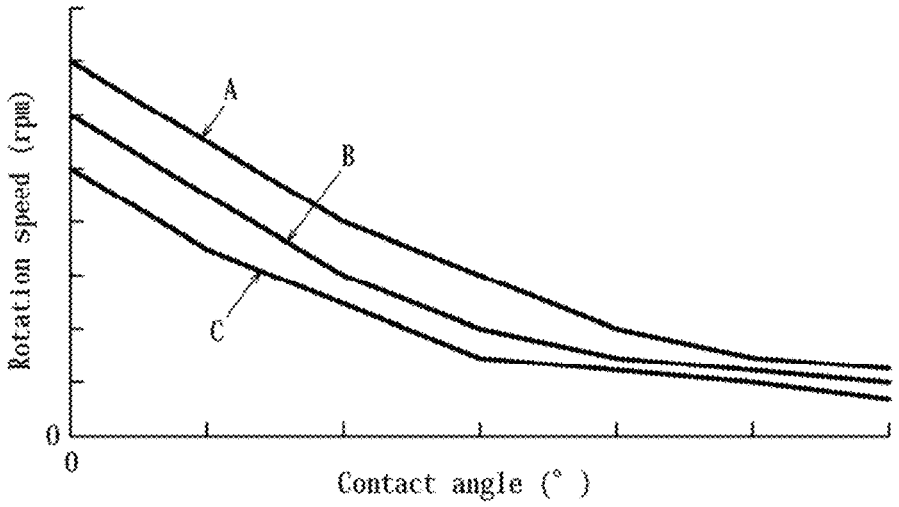
FIG. 7 is a graph showing the relationship between the contact angle of a polishing cloth and the rotation speed of a head and a surface plate with respect to three kinds of changes in the roll-off amount.
Figure 8:
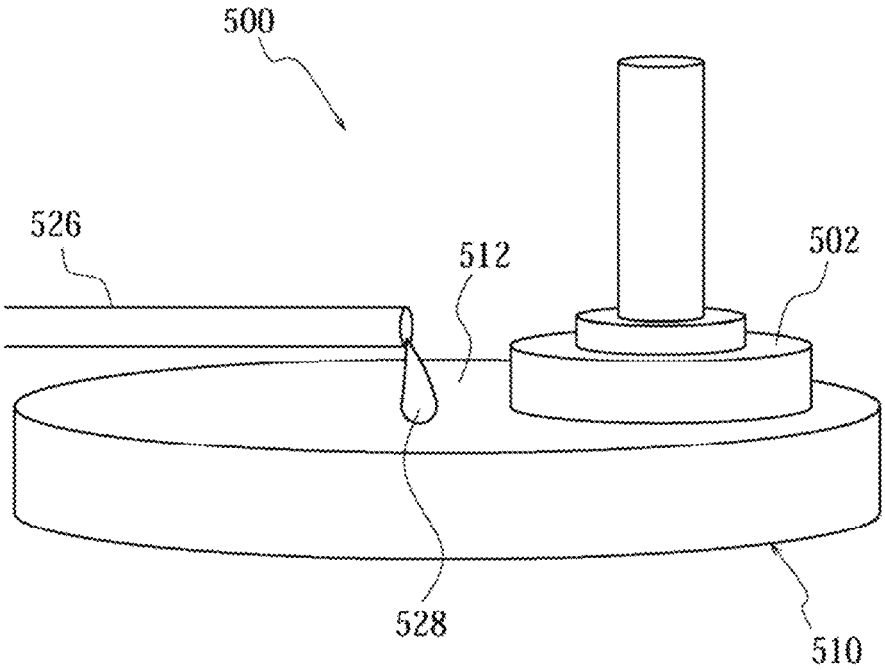
FIG. 8 is a schematic view of a conventional single side polishing apparatus for wafer 500.

In a case where the desired change in the roll-off amount is of one kind, only one standard curve can be used. However, even when each wafer has a different target change in the roll-off amount, the desired change in the roll-off amount can be accurately realized by preparing a plurality of standard curves for the respective changes in the roll-off amount and previously storing the standard curves in a memory. FIG. 7 shows standard curves obtained by determining three kinds of changes in the roll-off amount (A: 15 nm, B: 10 nm, C: 5 nm) based on the relationships shown in FIG. 4 and FIG. 5. In this case, the single side polishing apparatus 100 is required to first receive data of the target change in the roll-off amount of a wafer to be polished. The control unit 124 reads a data table of an appropriate standard curve from the memory based on the input change in the roll-off amount. Subsequent steps of the method for determining the rotation speed are described below.

Note that "wafer edge shape" herein means the shape of the rolled-off portion. Control of the wafer edge shape is not limited to the above control of change in the roll-off amount. Instead, any indicator which can have a correlation with the contact angle of a polishing cloth can be used, and the examples of the indicator includes ESFQR (Edge flatness Metric, Sector based, Front surface referenced, least sQuares fit reference plane, Range of the data within sector), ZDD (Z height Double Derivative), and the like.

The contact angle of the polishing cloth 112 may also serve as a powerful indicator for determining the life of the polishing cloth 112. Since polishing cloths are consumables, they have been discarded after having been used for polishing for a predetermined time, and replaced with a new polishing cloth. However, it has been difficult to determine whether a polishing cloth is still usable or not, since the period of time through which polishing cloths are worn out varies between the polishing cloths or depending on the polishing conditions. Therefore, the above predetermined time has been set to include a margin where polishing cloths are still usable. However, as described above, the contact angle of a polishing cloth is an indicator suitable for monitoring the surface condition of the polishing cloth, and it increases gradually from the initial stage to the final stage of the use thereof. Consequently, the stage where the contact angle reaches a predetermined threshold value can be used as the use limit of the polishing cloth.

In this case, the contact angle is measured at every polishing, and if the measured contact angle is equal to or less than the predetermined threshold value, the polishing cloth continues to be in use, whereas if the measured contact angle exceeds the predetermined threshold value, it is prompted to replace the polishing cloth having been unusable. Specifically, the single side polishing apparatus 100 stores data of a threshold value (contact angle) A in a memory (not shown). Upon receiving data of the contact angle B of the polishing cloth 122 output from the measuring device 122, the control unit 124 reads out the data of the threshold value A from the memory and compares it with the contact angle B. When the contact angle B is equal to or less than the contact angle A, the control unit 124 drives the motors 108 and 116, and the single side polishing apparatus 100 continues polishing using the polishing cloth. On the other hand, when the contact angle B exceeds the contact angle A, the control unit 124 stops driving or does not drive the motors 108 and 116. The control unit 124 may prompt the replacement of the polishing cloth using a notice means such as a voice or an indication on a display. Thus, the surface condition of the polishing cloth immediately before polishing is grasped, and the time for replacement of the polishing cloth can be appropriately determined, thereby using the polishing cloth up to the end of the proper useful life of the polishing cloth. Accordingly, the cost of manufacturing wafers can be reduced.

The threshold value of the contact angle of a polishing cloth depends on the kind, the hardness, the modulus of resilience, and the like of the polishing cloth. For example, when 1000 μg of water is used and the contact angle of a polishing cloth is measured by a measurement method of half angle method (θ/2 method), the threshold value may be 70°. Further, the determination of the life based on the contact angle of the polishing cloth described above may be carried out separately from the foregoing determination of the rotation speed of the head and the surface plate based on the contact angle of the polishing cloth.

(Method of Polishing One Side of Wafer)

Next, a method of polishing one side of a wafer according to the present invention will be described.

Figure 2:
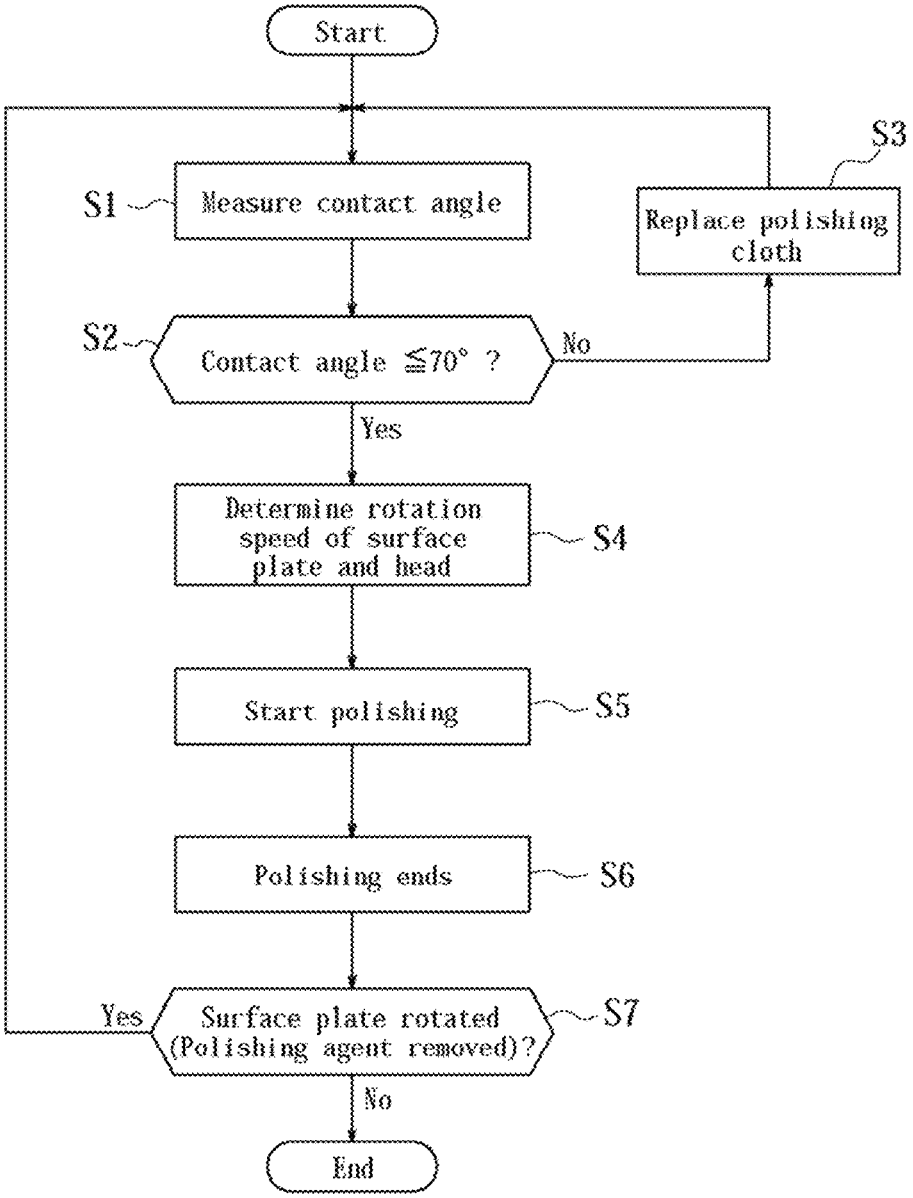
FIG. 2 is a flowchart of a method of polishing one side of a wafer, according to an embodiment of the present invention.

An embodiment of a method of polishing one side of a wafer according to the present invention will be described with reference to FIG. 2. First, the contact angle of the polishing cloth 112 is measured (step S1). Next, determination is carried out on whether the contact angle is equal to or less than a threshold value, for example 70° (step S2). When the contact angle is equal to or less than the threshold value, the process proceeds to step S4. When the contact angle exceeds the threshold value, the polishing cloth 112 is replaced (step S3), and the process is repeated from step S1.

In step 84, the rotation speed of the head 102 and the surface plate 110 is determined by the above described method based on the measured contact angle of the polishing cloth 112 and the relationship as shown in FIG. 6 and FIG. 7 between the contact angle of a polishing cloth of the same kind as the polishing cloth 112 and the rotation speed of the head 102 and the surface plate 110, which is previously determined for obtaining a certain change in the roll-off amount of a certain wafer 104.

Subsequently, polishing of one side of the wafer 104 is started by rotating the head 102 and the surface plate 110 at the determined rotation speed (step S5). The polishing ends after that (step S6). If another wafer is to be polished next, the polishing agent 128 on the polishing cloth 112 is removed by rotating the surface plate 110 (step S7), and the process is repeated from step S1. Thus, the contact angle of the polishing cloth for the polishing of the next wafer can be accurately measured. If no wafer is to be polished next, the process is terminated.

Figure 3:
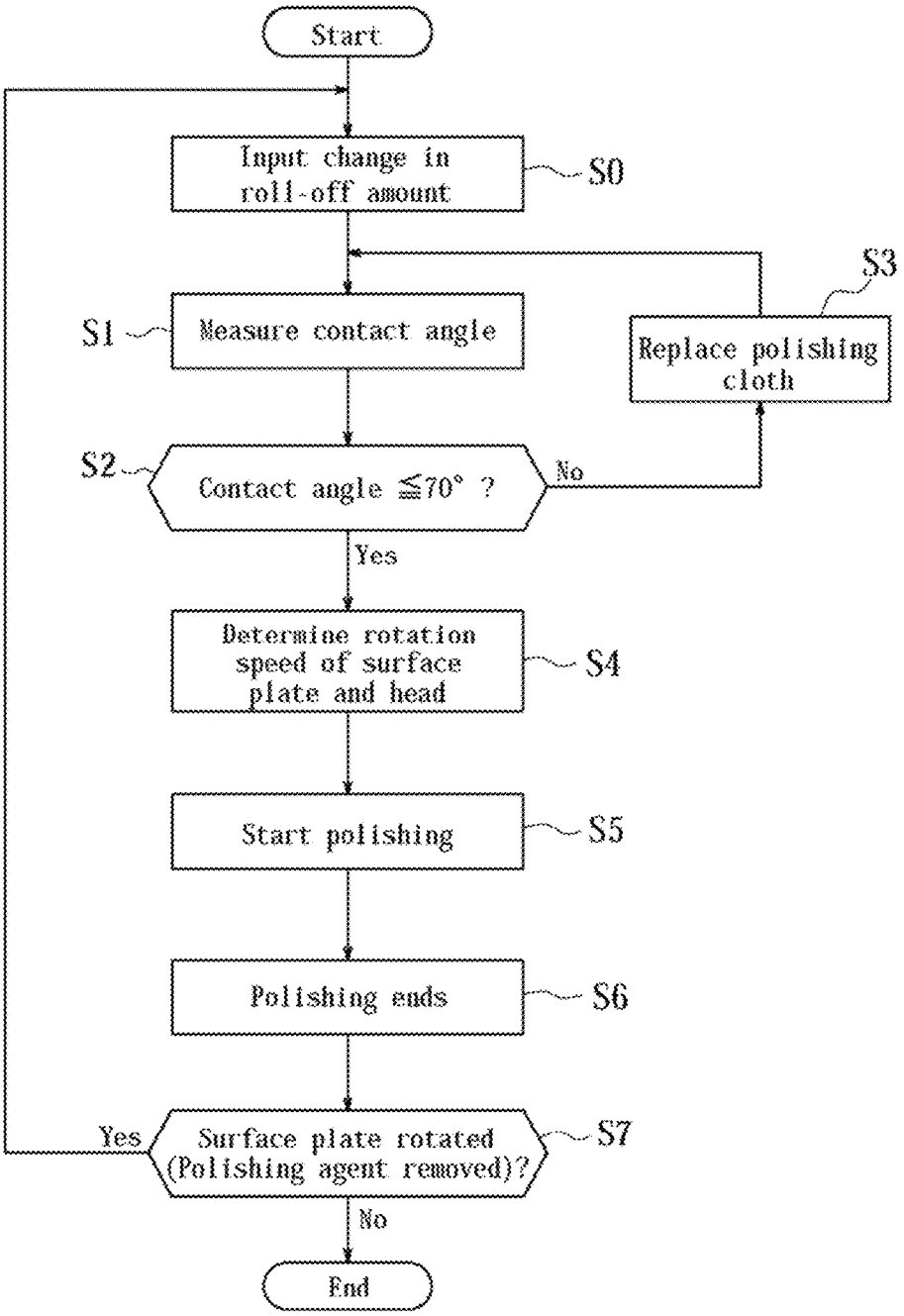
FIG. 3 is a flowchart of a method of polishing one side of a wafer, according to another embodiment of the present invention.

Further, a method of polishing one side of a wafer according to another embodiment of the present invention will be described with reference to FIG. 3. The method is the same as FIG. 2 except that step S0 is performed before step S1. In this embodiment, with respect to a plurality of changes in the roll-off amount, the relationship between the contact angle of the polishing cloth and the rotation speed of the head and the surface plate is determined in advance. In step S0, the target change in the roll-off amount of the wafer to be polished is input. A standard curve (data table) corresponding to the input change in the roll-off amount is selected. The subsequent steps are omitted since they are the same as those in FIG. 2. This embodiment can be used in cases where wafers are polished to cause different changes in the roll-off amount or where the target change in the roll-off amount is changed during polishing of the plurality of wafers.

The kind of the polishing cloth is not limited. For example, a single-layer polishing cloth or a two-layer polishing cloth in which a sponge layer is formed on the rear surface of a polishing cloth layer may be used. As the polishing cloth layer of the single-layer polishing cloth and the two-layer polishing cloth, for example, a polishing cloth composed of a synthetic resin foam such as urethane foam, a polishing cloth of a hard velour type in which a non-woven cloth made of polyester fabric is impregnated with a urethane resin, or a suede pad in which a urethane resin had foamed on a non-woven base fabric may be employed.

The location of the polishing cloth, to be supplied with a drop for measuring the contact angle is not limited as long as the wafer passes by the location in polishing.

For a polishing agent, for example, an alkaline polishing agent containing colloidal silica or the like as abrasive grains is used. The location to be supplied with the polishing agent is not limited in particular; however, the polishing agent is preferably supplied to the vicinity of the rotational orbit of the head 102 at the center.

EXAMPLES

Example

Six silicon wafers having a diameter of 300 mm were prepared and were subjected to finish-polishing using a single side polishing apparatus 100 shown in FIG. 1, in which a surface of a surface plate is provided with a suede polishing cloth. The polishing conditions were as follows.

Polishing pressure: 125 g/cm$^2$

Polishing time: 360 s

Polishing agent: alkaline polishing agent (containing colloidal silica)

Target change in roll-off amount: 15 nm

FIG. 6 shows a predetermined relationship between the contact angle (°) of a polishing cloth of the same kind as the polishing cloth and the rotation speed (rpm) of a head and the surface plate.

Prior to polishing of each silicon wafer, purified water was dropped on the polishing cloth, and the contact angle of the polishing cloth was measured using an automated contact angle meter (DMs-400Hi/400 manufactured by Kyowa Interface Science Co., Ltd.). Subsequently, based on the standard curve in FIG. 6, the rotation speed of the head and the surface plate was determined so as to obtain a change in the roll-off amount of 15 nm in accordance with the result of the measurement of the contact angle. The head and the surface plate were rotated at the determined rotation speed to start polishing of the wafer. The surface plate and the head were rotated in the same rotation direction. After the polishing, the polishing agent on the polishing cloth was removed by rotating the surface plate at 60 rpm for 30 s in order to finish-polish the next wafer.

The average of the changes in the roll-off amount of the six wafers was 15.20 nm, with a standard deviation of 1.15 nm.

Comparative Example

Finish-polishing was performed on six silicon wafers having a diameter of 300 mm under the following polishing conditions, with the target change in the roll-off amount being set to 15 nm as in Example 1. The rotation speed of the head and the surface plate was fixed at 15 rpm, and the other polishing conditions were the same as Example 1.

The average of the changes in the roll-off amount of the six wafers was 18.54 nm, with a standard deviation of 3.02 nm.

(Evaluation)

It is evident that the target changes in the roll-off amount of the six wafers were thoroughly realized accurately in Example as compared with Comparative Example.

INDUSTRIAL APPLICABILITY

A single side polishing method and a single side polishing apparatus of the present invention can accurately realize the desired wafer edge shape without dependence on the period of use of the polishing cloth by keeping track of the surface condition of a polishing cloth based on the contact angle, and determining the rotation speed of a surface plate and a head.

REFERENCE SIGNS LIST

100: Single side polishing apparatus for wafer
102: Head
104: Wafer
106: Head elevating shaft
108: Motor
110: Surface plate
112: Polishing cloth
114: Surface plate rotation shaft
116: Motor
118: Drop supply
120: Drop
122: Contact angle measuring device
124: Control unit
126: Polishing agent supply
128: Polishing agent

The invention claimed is:

1. A single side polishing apparatus for a wafer, comprising:

a head for fixing a wafer;

a surface plate having a surface provided with a polishing cloth;

a rotating mechanism for rotating the head and the surface plate, wherein:

the wafer fixed to the head is brought into contact with the polishing cloth, and the head and the surface plate are rotated to polish one side of the wafer, a measuring device operable to measure a contact angle of a drop of water supplied on the polishing cloth;

a memory having a data table stored thereon that defines a predetermined relationship between the contact angle of a polishing cloth of the same kind as the polishing cloth provided on the surface of the surface plate and a rotation speed of the head and the surface plate for obtaining a certain wafer edge shape; and a control unit, wherein the control unit is operable to perform the following steps:

accessing the data from the memory;

determining the rotation speed of the head and the surface plate, based on the predetermined relationship and on the contact angle of the polishing cloth, measured with the measuring device; and driving the rotating mechanism so that the head and the surface plate are rotated at the determined rotation speed.

2. The single side polishing apparatus for a wafer according to claim 1, wherein with respect to each of a plurality of certain wafer edge shapes, the relationship between the contact angle of a polishing cloth of the same kind as the polishing cloth provided on the surface of the surface plate and the rotation speed of the head and the surface plate is previously determined, and the rotation speed of the head and the surface plate is determined by using a relationship corresponding to a target wafer edge shape of the wafer to be polished.

3. The single side polishing apparatus for a wafer according to claim 2, wherein a polishing agent on the polishing cloth is removed by rotating the surface plate before measuring the contact angle.

4. The single side polishing apparatus for a wafer according to claim 3:

wherein when the measured contact angle is equal to or less than a threshold value, polishing is performed using the polishing cloth, and whereas when the measured contact angle exceeds the threshold value, the polishing is performed after the polishing cloth is replaced.

5. The single side polishing apparatus for a wafer according to claim 2:

wherein when the measured contact angle is equal to or less than a threshold value, polishing is performed using the polishing cloth; and whereas when the measured contact angle exceeds the threshold value, the polishing is performed after the polishing cloth is replaced.

6. The single side polishing apparatus for a wafer according to claim 1, wherein a polishing agent on the polishing cloth is removed by rotating the surface plate before measuring the contact angle.

7. The single side polishing apparatus for a wafer according to claim 6, wherein when the measured contact angle is equal to or less than a threshold value, polishing is performed using the polishing cloth; and whereas when the measured contact angle exceeds the threshold value, the polishing is performed after the polishing cloth is replaced.

8. The single side polishing apparatus for a wafer according to claim 1:

wherein when the measured contact angle is equal to or less than a threshold value, polishing is performed using the polishing cloth; and whereas when the measured contact angle exceeds the threshold value, the polishing is performed after the polishing cloth is replaced.

* * * * *